US006583611B2

(12) United States Patent
Serratoni

(10) Patent No.: US 6,583,611 B2
(45) Date of Patent: Jun. 24, 2003

(54) CIRCUIT GENERATOR OF A VOLTAGE SIGNAL WHICH IS INDEPENDENT OF TEMPERATURE AND HAS LOW SENSITIVITY TO VARIATIONS IN PROCESS PARAMETERS

(75) Inventor: Claudio Serratoni, Milan (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 09/920,442

(22) Filed: Aug. 1, 2001

(65) Prior Publication Data

US 2002/0050811 A1 May 2, 2002

(30) Foreign Application Priority Data

Aug. 3, 2000 (EP) ..... 00830559

(51) Int. Cl.[7] ..... G05F 3/16
(52) U.S. Cl. ..... 323/313; 323/315
(58) Field of Search ..... 323/312, 313, 323/316, 315

(56) References Cited

U.S. PATENT DOCUMENTS 4,300,091 A * 11/1981 Schade, Jr. ..... 323/315
4,769,589 A * 9/1988 Rosenthal ..... 323/313
5,157,285 A 10/1992 Allen ..... 307/465
5,614,816 A * 3/1997 Nahas ..... 323/316
5,672,960 A * 9/1997 Manaresi et al. ..... 323/313
5,818,294 A 10/1998 Ashmore, Jr. ..... 327/543
6,016,051 A 1/2000 Can ..... 323/315

* cited by examiner

*Primary Examiner*—David Nelms
*Assistant Examiner*—Thao P Le
(74) *Attorney, Agent, or Firm*—Lisa K. Jorgenson; Dennis M. de Guzman; Seed IP Law Group PLLC

(57) ABSTRACT

The invention relates to a circuit generating a voltage signal which is independent of temperature and has low sensitivity to variations in process parameters, comprising at least an output MOS transistor through which an output current flows, it being connected to a first voltage reference and having a gate terminal connected to a bias network, in turn connected between a second voltage reference and the first voltage reference. The circuit of this invention includes a bias network comprising at least first and second MOS transistors connected in a diode configuration, connected in series between said first and second voltage references, and connected to the second voltage reference through a current generator element having a thermal gradient that approximates the thermal gradient of a MOS transistor.

12 Claims, 2 Drawing Sheets

CIRCUIT GENERATOR OF A VOLTAGE SIGNAL WHICH IS INDEPENDENT OF TEMPERATURE AND HAS LOW SENSITIVITY TO VARIATIONS IN PROCESS PARAMETERS

BACKGROUND OF THE INVENTION

1. Field of the Invention

This invention relates to a circuit generating a voltage signal which is independent of temperature and has low sensitivity to variations in process parameters.

More particularly, the invention relates to a circuit comprising at least an output MOS transistor, through which an output current flows, being connected to a first voltage reference, and having a gate terminal connected to a bias network connected between a second voltage reference and said first voltage reference.

2. Description of the Related Art

In order to generate a signal which is independent of temperature and has low sensitivity to process parameter variations, temperature-independent current generators have been used, which charge and discharge a capacitor.

In order to provide such a current generator, the current-voltage characteristic $I_D$(Vgs) of a MOS transistor is used. As schematically illustrated in FIG. 1, a reference voltage Vgsx can always be found at which the current $I_{DX}$ flowing through a MOS transistor will not vary with temperature T.

In particular, FIG. 1 illustrates the current-voltage characteristic of a MOS transistor at three different temperatures T1, T2 and T3. This characteristic shows a zero-temperature-coefficient point X at the reference voltage Vgsx where the current $I_D$ does not vary with temperature.

Thus, by applying such a bias voltage Vgsx between the gate and source terminals of a MOS transistor, the transistor is led to conduct a temperature-independent current $I_{DX}$ between the source and drain terminals.

In particular, the current $I_D$, or drain current, which flows through a MOS transistor operating in its linear region, is given by:

$$I_D = \frac{1}{2}\cdot\mu\cdot Cox\cdot\frac{W}{L}\cdot(Vgs - Vth)^2 = \frac{1}{2}\cdot\mu\cdot Cox\cdot\frac{W}{L}\cdot\Delta V^2 \quad (1)$$

where: $\mu$ is electron mobility; Cox is the capacitance of silicon oxide; Vgs is the bias voltage of the gate terminal, that is, the voltage applied between the gate and source terminals; and Vth is the transistor threshold voltage.

Those parameters which vary appreciably with the temperature T are the mobility $\mu$ and the threshold voltage Vth, while the variation of the capacitance Cox is negligible.

In particular, the threshold voltage Vth is known to decrease almost linearly as the temperature T increases, this variation obeying the following equation:

$$Vth(T)=Vth(T_0)+CT_{MOS}\cdot(T-T_0) \quad (2)$$

where $CT_{MOS}$ is the thermal coefficient of the MOS transistor and $T_0$ is room temperature.

Thus, the term depending on the voltage variation, $\Delta V^2$, increases in equation (1) as the square of the change in temperature T.

Also, the mobility $\mu$, as a function of the temperature T, obeys the following equation:

$$\mu(T) = \mu_0\cdot\left(\frac{T}{T_0}\right)^{-\alpha} \quad (3)$$

where $\alpha$ is a coefficient with a value in the range of 1.5 to 2.

The zero-temperature-coefficient point X in the diagram of FIG. 1, where the current $I_D$ and the voltage Vgs are independent of the temperature T, is analytically calculated by assuming that the first derivatives of those functions which represent the values of $I_D$ and Vgs with respect to the temperature T are simultaneously zero.

If $\partial I_D(T)/\partial T=0$, then:

$$Vgs(t) = 2\cdot\frac{T}{\alpha}\cdot\left(\frac{\partial Vgs(T)}{\partial T} - CT_{MOS}\right) + Vth(T_0) + CT_{MOS}\cdot(T - T_0) \quad (4)$$

Now, if $\partial Vgs(T)/\partial T=0$, then:

$\alpha=2$

In conclusion, there exists a point where, once an appropriate voltage Vgs is set, the current $I_D$ flowing through a MOS transistor does not vary with temperature if the coefficient $\alpha$ equals 2.

However, the variation of the current $I_D$ with the temperature T is quite small when the coefficient $\alpha$ is between 1.5 and 2.

As for the variations related to the manufacturing process of the MOS transistor, it is well known that the threshold voltage Vth and the capacitance Cox are appreciably affected by such variations, causing the current $I_D$ to also become dependent on process variations.

On the other hand, the mobility $\mu$ varies very little with the variations in process parameters; it primarily depends on the dopant element, and can be set with an accuracy of within 5%, so that the mobility $\mu$ is one of the best controlled parameters.

Thus, it is necessary to compensate the error introduced by the capacitance Cox variation, or the variation in the thickness of the gate oxide, and by the threshold voltage Vth variation.

If the capacitor C1 dielectric is formed using the gate oxide layer of the MOS transistor, variations in the capacitance Cox are compensated by the capacitor C1, thus reducing its dependence on the process parameter variations.

As for the threshold voltage Vth of the MOS transistor, a circuit configuration, connected to the capacitor C1 and the MOS transistor functioning as a current generator, is used in order to force the transistor to operate at the calculated zero-temperature-coefficient point X to decrease its dependence on temperature.

A known circuit that generates a constant voltage signal is generally shown at 1 in FIG. 2, in schematic form.

The circuit 1 comprises a capacitor C1 connected between a first supply voltage reference Vcc and a constant current generator 2, the circuit 1 basically consisting of a MOS transistor $M_{out}$ and a bias network 3.

The transistor $M_{out}$ has a gate terminal G connected to the bias network 3, a drain terminal D connected to a terminal of the capacitor C1 to form an output terminal OUT, and a source terminal S connected to a second voltage reference, specifically a ground reference GND.

The voltage Vout at the node OUT, therefore, depends on the charged state of the capacitor C1.

The bias network 3 comprises first M1 and second M2 MOS transistors connected in a diode configuration, that is, each with its respective gate and drain terminals connected, these transistors being connected in series between the supply voltage Vcc and ground GND references. In particular, the first transistor M1 is connected to the supply voltage reference Vcc through a current mirror 4.

The current mirror 4 is further connected to the ground reference GND through a series of a first bipolar transistor Q1 and a first resistive element R1, the latter comprising a resistor pair R1*a* and R1*b*.

The second transistor M2 is further connected to the ground reference GND through a second resistive element R2, the latter comprising a resistor pair R2*a* and R2*b*.

The bias network 3 also includes a third MOS transistor M3, connected between the supply voltage reference Vcc and the gate terminal G of the transistor Mout, the latter connected to the ground reference GND through a second bipolar transistor Q2 and a third resistive element R3 connected in series.

The third transistor M3 has a gate terminal connected to the gate terminal of the first transistor M1.

Finally, the first Q1 and second Q2 bipolar transistors have base terminals in common and connected to a bias voltage reference Vpol.

As shown in FIG. 2, the current mirror 4 particularly comprises fourth Q4, fifth Q5 and sixth Q6 bipolar transistors which are connected to the supply voltage reference Vcc through fourth R4, fifth R5 and sixth R6 resistive elements, respectively.

The fourth bipolar transistor Q4 is further connected to the first bipolar transistor Q1, and has a base terminal connected to the base terminal of the fifth bipolar transistor Q5, the latter in turn connected to the first MOS transistor M1.

The sixth bipolar transistor Q6 is connected to the ground reference GND, and has a base terminal connected to the first bipolar transistor Q1.

The operation of the circuit 1 shown in FIG. 2 will now be discussed.

The bias network 3 essentially functions to bias the MOS transistor $M_{OUT}$ at the point where, with a given voltage Vgs set, the current $I_D$ flowing through it does not vary with the temperature T.

In particular, the voltage Vgsout between the gate and source terminals of the transistor $M_{OUT}$ is given by:

$$Vgsout(T)=Vgs1+Vgs2+\Delta V(T)-Vgs3 \tag{5}$$

where: Vgs1, Vgs2 and Vgs3 are the gate-source voltages of the transistors M1, M2 and M3; and ΔV(T) is an appropriate voltage added by the bias network 3 in order to stabilize Vgsout with respect to temperature.

Equation (5) may also be written as:

$$Vgsout(T) = Vth(T) + \sqrt{\frac{2\cdot I\cdot L1}{\mu\cdot Cox\cdot W1}} + \sqrt{\frac{2\cdot I\cdot L2}{\mu\cdot Cox\cdot W2}} + \Delta V(T) - \sqrt{\frac{2\cdot 2I\cdot L3}{\mu\cdot Cox\cdot W3}} \tag{6}$$

where: L1/W1, L2/W2 and L3/W3 are the aspect ratios of the transistors M1, M2 and M3; I is the current flowing through the transistors M1 and M2; and 2I is the current flowing through the transistor M3.

The overall contribution of the expressions under the radical signs can be eliminated if transistors with suitably selected sizes are used. Specifically in this case, given:

$$(W1/L1)=(W2/L2)=2(W3/L3),$$

the following equation is arrived at:

$$Vgsout(T)=\Delta V(T)+Vth(T)=\Delta V(T)+Vth(T_0)+CT_{MOS}(T-T_0) \tag{7}$$

The desired zero-temperature-coefficient point X, that is, the point where the current $I_D$ and the voltage Vgs of the transistor $M_{OUT}$ are constant when the temperature T varies, is found by substituting ∂Vgsout(t)/∂T=0 in equation (4) when applied to the transistor $M_{OUT}$, so that:

$$Vgsout(T) = -\frac{2}{\alpha}\cdot T\cdot CT_{MOS} + Vth(T_0) + CT_{MOS}(T-T_0) \tag{8}$$

From equation (8), at room temperature To:

$$Vgsout(T_0) = -\frac{2}{\alpha}\cdot T_0\cdot CT_{MOS} + Vth(T_0) \tag{9}$$

A comparison of equations (9) and (7) shows that, again at room temperature $T_0$:

$$\Delta V(T_0) = -\frac{2}{\alpha}\cdot T_0\cdot CT_{MOS} \tag{10}$$

Assuming the derivative of the voltage Vgsout with respect to temperature to be zero, then equation (7) becomes:

$$\frac{\partial\Delta V(T)}{\partial T} = -CT_{MOS} \tag{11}$$

In summary, for the transistor $M_{OUT}$ to work at the desired zero-temperature-coefficient point X and function independently of temperature, the following additional voltage difference ΔV should be applied:

$$\Delta V(T) = -\frac{2}{\alpha}\cdot T_0\cdot CT_{MOS} - CT_{MOS}(T-T_0) \tag{12}$$

In particular, the bias network 3 of FIG. 2 provides a bias voltage to the transistor $M_{OUT}$ which obeys equation (12). In fact, the first bipolar transistor Q1, which has a similar thermal gradient to that of the transistor $M_{OUT}$, has a voltage $V_{BE}$ which is substantially independent of process variations.

It should be noted that the same result could not be obtained by using a temperature-independent voltage reference circuit (as provided by a band-gap circuit, for example), and subtracting a gate-source voltage Vgs therefrom. This is because the voltage difference ΔV thus obtained depends on the threshold voltage of the MOS transistor used, and hence is heavily dependent on process variations, the transistor $M_{OUT}$ being directly biased by the bias voltage Vpol.

In particular, according to FIG. 2, the voltages at the ends of the first resistive element R1 are equal to the voltages at the ends of the second resistive element R2, since these elements have the same resistance and are supplied current by the current mirror 4.

The voltage difference ΔV obtained by the circuit of FIG. 2 is therefore given by:

$$\Delta V(T)=Vpol-V_{BE1}(T)=Vpol-V_{BE1}(T_0)-CT_{BJT}(T-T_0) \tag{13}$$

where $CT_{BJT}$ is the thermal coefficient of the bipolar transistors.

An appropriate value of the bias voltage Vpol obtained from equation (13) for application to the bias network 3, in order to have the transistor $M_{OUT}$ operating at the desired zero-temperature-coefficient point X, is:

$$Vpol = \Delta V(T) + V_{BE1}(T) = -\frac{2}{\alpha} \cdot T_0 \cdot CT_{MOS} + V_{BE1}(T_0) \tag{14}$$

However, this solution has a disadvantage in that it requires a sufficiently accurate bias voltage reference Vpol so that the transistor $M_{OUT}$ can function in such a way as to lessen the effects of temperature.

Such a value of the bias voltage reference Vpol depends on the voltage $V_{BE1}(T_0)$ of the first bipolar transistor Q1, such a voltage being dependent on the process variations.

Finally, the variation of the bias voltage $V_{BE1}(T_0)$ with temperature follows a different pattern than the variation of the gate-source voltage of a MOS transistor with temperature, since MOS transistors and bipolar ones have different thermal coefficients ($CT_{MOS}$=−2.2 mV/° C.; $CT_{BJT}$=−1.85 mV/° C.).

SUMMARY OF THE INVENTION

This invention comprises a circuit generating a voltage signal which is independent of temperature and has low sensitivity to process parameter variations, the circuit requiring no special bias reference and overcoming the limitations of the prior art.

The basic idea on which this invention stands is one of using a bias network for a MOS transistor comprising a current generator element which has a thermal gradient that approximates the thermal gradient of the MOS transistor.

In particular, the current generator element comprises at least a first current generator formed by bipolar transistors, and a second current generator formed by a voltage reference which is independent of temperature, such as a band-gap reference.

BRIEF DESCRIPTION OF THE DRAWINGS

The features and advantages of a circuit according to this invention will be more clearly apparent from the following description of an embodiment thereof shown, by way of non-limitative example, in the accompanying drawings.

DETAILED DESCRIPTION OF THE INVENTION

Figure 1:
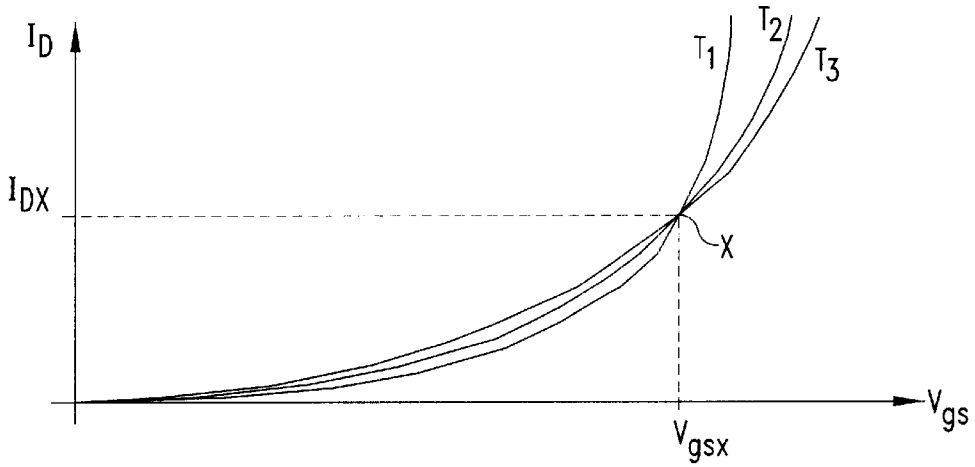
Fig. 1 (Prior Art)
FIG. 1 shows a diagram of the current vs. voltage characteristics of a MOS transistor at three different temperatures.
Figure 2:
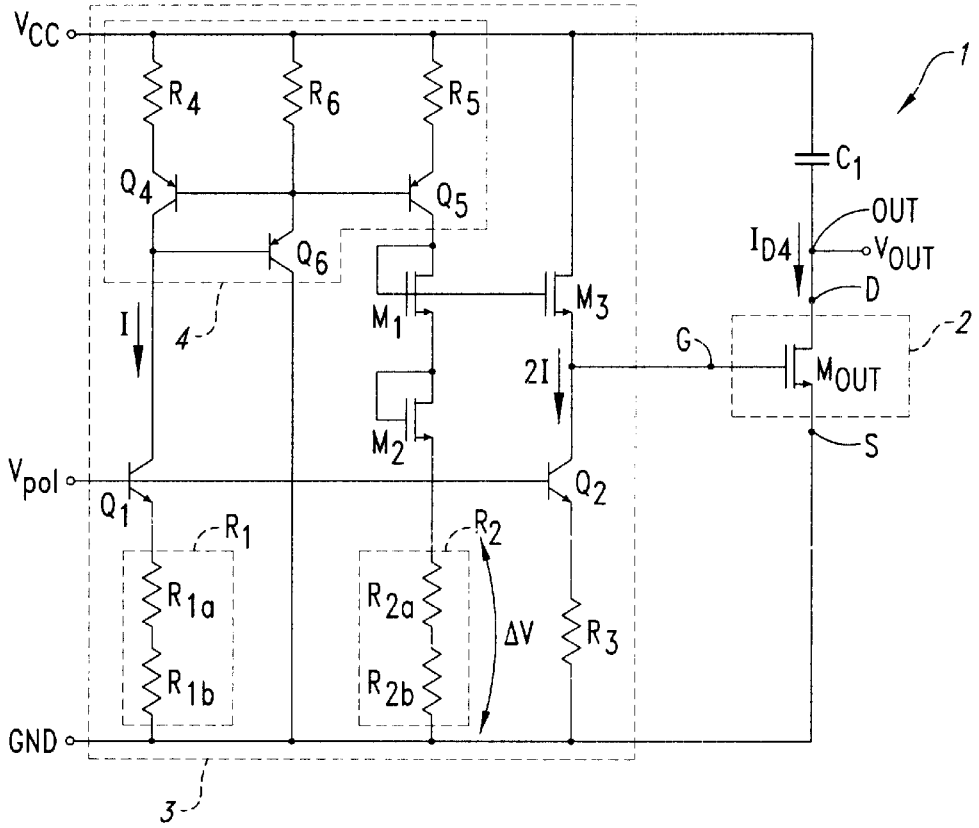
Fig. 2 (Prior Art)
FIG. 2 schematically shows a conventional circuit generating a constant electric signal.
Figure 3:
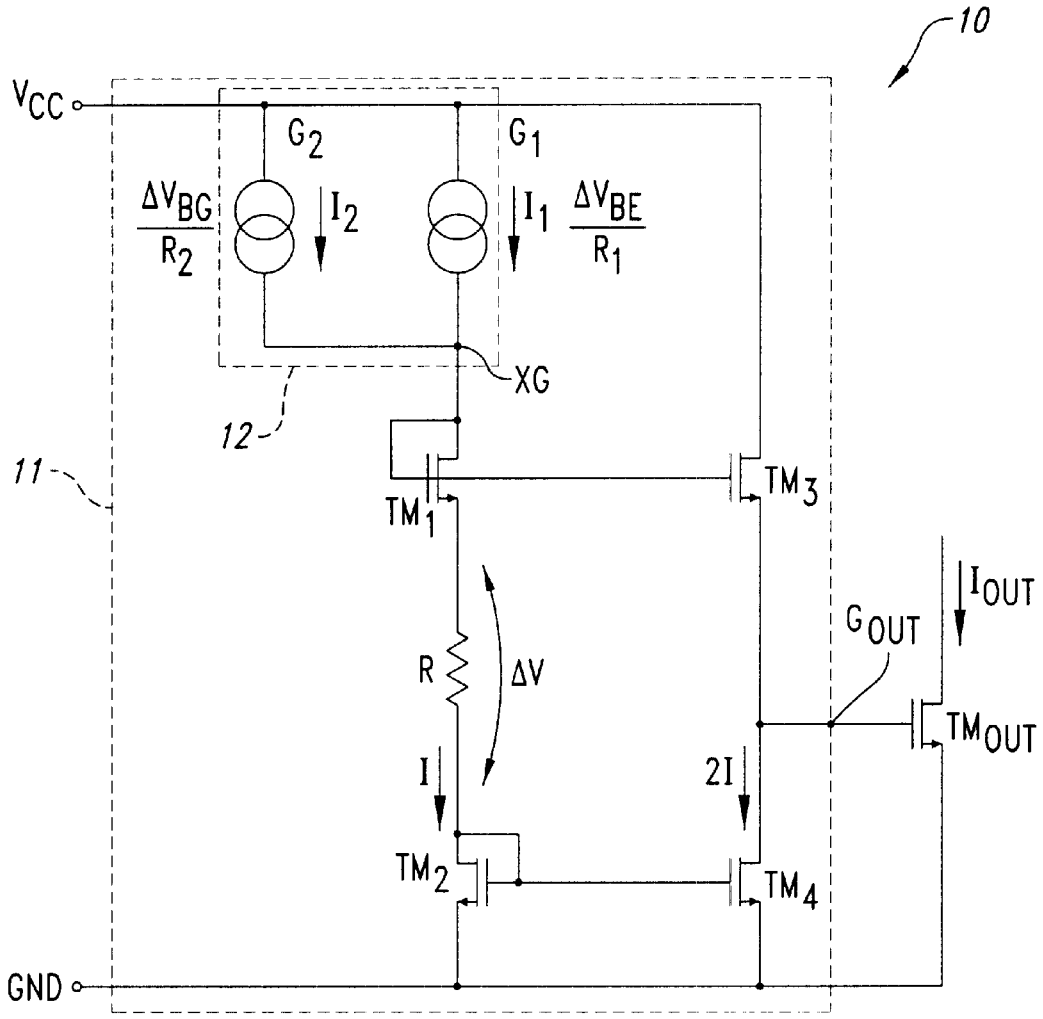
FIG. 3 schematically shows a circuit generating constant electric signal which is independent of temperature and process parameter variations, according to this invention.

Referring in particular to FIG. 3, a circuit according to the invention for generating a voltage signal which is independent of temperature and has low sensitivity to variations in the process parameters, is shown generally at 10 in schematic form.

The circuit 10 comprises an output MOS transistor $TM_{OUT}$ which has an output current $I_{OUT}$ and is connected to a voltage reference, such as a ground reference GND. The output transistor $TM_{OUT}$ has a gate terminal $G_{OUT}$ connected to a bias network 11, which is in its turn connected between a supply voltage reference Vcc and said ground reference GND.

The bias network 11 of this invention comprises first TM1 and second TM2 MOS transistors in a diode configuration, that is, each having its gate and drain terminals connected, which transistors are connected in series between the supply voltage reference Vcc and the ground reference GND. In particular, the first transistor TM1 is connected to the supply voltage reference Vcc through a current generator element 12.

The current generator element 12 comprises first G1 and second G2 current generators leading to a common node XG.

An advantage of this invention is that the first current generator G1 is formed by means of bipolar transistors, in a manner known to those skilled in the relevant art, and supplies a first current I1 given as:

$$I1 = \frac{\Delta V_{BE}}{R1} \tag{15}$$

where $\Delta V_{BE}$ is an equivalent voltage variation and $R_1$ is an equivalent resistance of the first current generator G1.

The second current generator G2 is formed by means of a voltage reference which is independent of temperature, such as a band-gap reference, and well known to those skilled in the relevant art. This current generator supplies a second current I2 given as:

$$I2 = \frac{\Delta V_{BG}}{R_2} \tag{16}$$

where $\Delta V_{BG}$ is a band-gap voltage variation and $R_2$ is an equivalent resistance of the second current generator G2.

The first TM1 and second TM2 transistors are also connected to each other through a resistive element R.

The bias network 11 further comprises third TM3 and fourth TM4 MOS transistors which are connected in series between the supply reference Vcc and the ground reference GND, and are connected to the gate terminal $G_{OUT}$ of the transistor $TM_{OUT}$.

In addition, the third transistor TM3 has a gate terminal connected to the gate terminal of the first transistor TM1, and the fourth transistor TM4 has a gate terminal connected to the gate terminal of the second transistor TM2.

Another advantage of this invention is that the bias network 11 configuration is such that a current 21 flows through the leg containing the transistors TM3 and TM4 which is two times larger than a current I flowing through the leg containing the transistors TM1 and TM2.

The operation of the circuit 10 according to the invention will now be described.

In order to obtain the required thermal gradient for a suitable biasing of the transistor $TM_{OUT}$, which is regulated by the equation (13) previously discussed with reference to the prior art, the circuit 10 of this invention uses the temperature pattern of the current generator G1.

The following equation applies to this generator:

$$\frac{\Delta V_{BE}(T)}{R_1} = \frac{K}{q} \cdot T \cdot \frac{\ln(A)}{R_1} \tag{17}$$

where A is the area ratio of the bipolar transistors by means of which the current generator G1 is formed.

Therefore, the voltage at the ends of the resistive element R of the bias network 11 is given by:

$$\Delta V(T) = \Delta V_{BE}(T) \cdot \frac{R}{R_1} = \frac{K}{q} \cdot \ln(A) \cdot \frac{R}{R_1} \cdot T \tag{18}$$

Thus, to obtain the required thermal gradient, it should be:

$$\frac{K}{q} \cdot \ln(A) \cdot \frac{R}{R_1} = -CT_{MOS} \tag{19}$$

It is actually found that equation (18) is not adequate to provide proper biasing of the transistor $TM_{OUT}$ at the desired zero-temperature-coefficient point X.

The second generator G2 is, therefore, added to increase the voltage drop, independent of temperature, across the resistive element R. This forces the transistor $TM_{OUT}$ to operate at the desired zero-temperature-coefficient point X.

Specifically, the voltage drop ΔV on the resistive element R is given by:

$$\Delta V(T) = \Delta V_{BE}(T) \cdot \frac{R}{R_1} + V_{BG} \cdot \frac{R}{R_2} = \frac{K}{q} \cdot \ln(A) \cdot \frac{R}{R_1} \cdot T + V_{BG} \cdot \frac{R}{R_2} \tag{20}$$

A comparison of equation (20) above with equation (13) obtained with reference to the prior art shows that:

$$\frac{K}{q} \cdot \ln(A) \cdot \frac{R}{R_1} \cdot T = -CT_{MOS} \cdot T \tag{21}$$

and that:

$$V_{BG} \cdot \frac{R}{R_2} = \frac{\alpha - 2}{\alpha} \cdot CT_{MOS} \cdot T_0 \tag{22}$$

Thus, the circuit 10 of this invention advantageously provides a voltage variation ΔV with a thermal gradient which is very close to the thermal gradient of an MOS transistor, and does so with good accuracy.

In one embodiment of the invention, the thermal gradient of the current generator element 12 mimics that of a standard MOS transistor for a particular process. In an alternative embodiment of the invention, the characteristics of the current generator element 12 are selected to mimic the thermal characteristics of the particular output MOS transistor $TM_{OUT}$ in order to provide ever-increased sensitivity.

Equation (21) shows the resistance ratio R/R1 and the area ratio A of the bipolar transistors as the only parameters which depend on process variations. In actual practice, these parameters can be controlled with great accuracy. In particular, the resistance ratio R/R1 has an accuracy within 1%, and the effect of the area ratio A variation is lessened by a natural log function.

Equation (22) likewise includes a resistance ratio R/R2, as well as the value of the band-gap voltage reference $V_{BG}$. The last-mentioned parameter is the most affected by process variations.

In reality, the contribution of the band-gap voltage $V_{BG}$ to the voltage ΔV obtained by the circuit 10 is approximately 1/7. Accordingly, the variation of the band-gap voltage $V_{BG}$ will affect the voltage ΔV only slightly.

However, this dependence can be limited by using a band-gap reference generating circuit which can be calibrated by firing, as it is known in the art.

In conclusion, the circuit of this invention provides a voltage signal which is independent of temperature and has low sensitivity to process variations. Therefore, a charge/discharge time of a capacitor connected thereto, as mentioned in connection with the prior art, which is also independent of temperature and has low sensitivity to process variations, corresponds to the following equation of proportionality:

$$\Delta t \propto \frac{C}{I} = \frac{C_1}{\frac{1}{2} \cdot \mu \cdot C_{OX} \cdot \frac{W}{L} \cdot (\Delta V)^2} = \frac{2 \cdot \frac{C_1}{C_{OX}}}{\mu \cdot \frac{W}{L} \cdot \left(\frac{K}{q} \cdot \ln(A) \cdot \frac{R}{R_1} \cdot T + V_{BG} \cdot \frac{R}{R_2}\right)^2} \tag{23}$$

In particular, the circuit of this invention can be connected to a capacitor to charge/discharge it in a manner independent of both temperature and process parameter variations.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A circuit comprising:

an output MOS transistor to produce an output current and being connected to a first voltage reference, the output MOS transistor having a gate terminal and a threshold voltage;

a bias network connected to the gate terminal of the output MOS transistor and connected between a second voltage reference and said first voltage reference; and said bias network comprising first and second MOS transistors being connected in a diode configuration, said first and second MOS transistors connected in series between said first and second voltage references and connected to said second voltage reference through a current generator element, wherein the output current is independent from the threshold voltage.

2. The circuit according to claim 1 wherein said current generator element comprises at least a first current generator formed of bipolar transistors and supplying a first current given as:

$$I1 = \frac{\Delta V_{BE}}{R1}$$

where $\Delta V_{BE}$ is an equivalent voltage across said first current generator, and $R_1$ is an equivalent resistance of said first current generator.

3. The circuit according to claim 2 wherein said current generator element further includes a second current generator supplying a second current given as:

$$I2 = \frac{\Delta V_{BG}}{R_2}$$

where $\Delta V_{BG}$ is a voltage across said second current generator, and $R_2$ is an equivalent resistance of said second current generator.

4. The circuit according to claim 3 wherein said first and second current generators are connected to each other at a common node, the common node being connected to said first MOS transistor.

5. The circuit according to claim 3 wherein said second current generator includes a voltage reference circuit which is independent of temperature and is of the band-gap type.

6. The circuit according to claim 1 wherein the current generator element has a thermal gradient that approximates the thermal gradient of an MOS transistor.

7. The circuit according to claim 1 wherein said first and second MOS transistors are connected to each other through a resistive element.

8. The circuit according to claim 1 wherein said bias network further comprises third and fourth MOS transistors connected in series between said first and second voltage references and connected at said gate terminal of the output MOS transistor.

9. The circuit according to claim 8 wherein said third MOS transistor has a gate terminal connected to the gate terminal of the first MOS transistor, and wherein said fourth MOS transistor has a gate terminal connected to the gate terminal of the second MOS transistor.

10. The circuit according to claim 1 further including a power supply circuit coupled to the first and second voltage references to supply power to the circuit such that the circuit provides an output voltage signal that has low sensitivity to variations in temperature and to variations in process parameters.

11. The circuit according to claim 1 including a capacitor connected to the output MOS transistor.

12. The circuit according to claim 11 wherein said capacitor is charged and discharged to provide a time signal that has low sensitivity to variations in temperature and variations in process parameters.

* * * * *